US010252315B2

(12) United States Patent
Moeggenborg

(10) Patent No.: US 10,252,315 B2
(45) Date of Patent: Apr. 9, 2019

(54) METAL PUNCH ASSEMBLY AND METHOD OF USE THEREOF

(71) Applicant: Howard Moeggenborg, Alma, MI (US)

(72) Inventor: Howard Moeggenborg, Alma, MI (US)

(73) Assignee: HOROMO, LLC, Alma, MI (US)

( * ) Notice: Subject to any disclaimer, the term of this patent is extended or adjusted under 35 U.S.C. 154(b) by 47 days.

(21) Appl. No.: 15/188,384

(22) Filed: Jun. 21, 2016

(65) Prior Publication Data

US 2016/0368037 A1 Dec. 22, 2016

Related U.S. Application Data

(60) Provisional application No. 62/183,173, filed on Jun. 22, 2015.

(51) Int. Cl.
*B21D 28/24* (2006.01)
*B21D 28/26* (2006.01)

(52) U.S. Cl.
CPC ..... *B21D 28/243* (2013.01); *B21D 28/26* (2013.01)

(58) Field of Classification Search
CPC ..... B21D 28/243; B21D 28/26; B21D 28/32; B21D 28/246; E04D 15/04; B26F 1/04
USPC ..... 83/687, 691, 553, 549, 132, 599, 686; 30/385–368, 364, 367, 344; 72/356, 334, 72/379.2, 335, 325, 327, 55, 333
See application file for complete search history.

(56) References Cited

U.S. PATENT DOCUMENTS 268,886 A * 12/1882 Hall ..... A21C 11/106 30/130
851,656 A * 4/1907 Dahly ..... B44C 7/02 269/293
1,180,357 A * 4/1916 Whitney ..... B21D 28/243 30/361
1,500,576 A * 7/1924 Cusi ..... B41K 3/38 101/109
1,728,475 A * 9/1929 Cavill ..... B26F 1/04 83/468
1,742,216 A * 1/1930 Rauber ..... B26F 1/32 346/104
2,163,641 A * 6/1939 Wales ..... B21D 28/243 83/140
2,418,984 A * 4/1947 Payne ..... B21D 28/32 30/368
2,526,528 A * 10/1950 Zickler ..... B25D 5/00 33/677
2,526,910 A * 10/1950 Smith ..... B25B 27/143 29/433
2,639,010 A * 5/1953 Weber ..... E04D 3/3605 52/336
2,726,721 A * 12/1955 Segal ..... B26F 1/36 30/358
2,784,405 A * 3/1957 Working, Jr. ..... B25C 1/005 206/346

(Continued)

*Primary Examiner* — Laura M Lee
(74) *Attorney, Agent, or Firm* — Robert C. Corbett

(57) ABSTRACT

A metal punch assembly for use with a ridged metal sheet includes a base member that defines a plurality of grooves. A plurality of punches are movably connected to the base member and are translatable from a retracted position to an extended position. The grooves formed by the base member are engageable with the ridges on the sheet such that the motion of the apparatus is limited to translation in two opposite directions.

2 Claims, 9 Drawing Sheets

(56) References Cited

U.S. PATENT DOCUMENTS

| | | | | | |
|---|---|---|---|---|---|
| 3,110,079 | A * | 11/1963 | Novy | B21D 39/025 | 29/21.1 |
| 3,141,532 | A * | 7/1964 | Runyan | E04D 3/3606 | 29/432 |
| 3,777,399 | A * | 12/1973 | Rockel | B21D 28/32 | 30/361 |
| 3,837,251 | A * | 9/1974 | Schneider | B26F 1/36 | 83/449 |
| 4,527,337 | A * | 7/1985 | Dreiling | G01B 5/02 | 30/358 |
| 5,068,976 | A * | 12/1991 | Bell | B23B 47/287 | 33/574 |
| 5,367,783 | A * | 11/1994 | Nygren | E04G 21/1891 | 33/478 |
| 6,622,908 | B2 * | 9/2003 | Fukumoto | B26F 1/04 | 234/98 |
| 7,066,002 | B2 | 6/2006 | Price et al. | | |
| 2005/0199034 | A1 * | 9/2005 | Price | B21D 22/04 | 72/450 |
| 2009/0188193 | A1 * | 7/2009 | Studebaker | E04B 5/40 | 52/321 |
| 2016/0368037 | A1 * | 12/2016 | Moeggenborg | B21D 28/243 | |

* cited by examiner

METAL PUNCH ASSEMBLY AND METHOD OF USE THEREOF

CROSS REFERENCE TO RELATED APPLICATION

This application claims the benefit of U.S. Provisional Application No. 62/183,173, filed Jun. 22, 2015, and which is hereby incorporated by reference in its entirety.

TECHNICAL FIELD

This disclosure relates to punches for forming holes in metal sheets.

BACKGROUND

Metal sheets are often used in building construction, such as to form roofs or walls. The metal sheets are typically attached to a frame or roof beams by fasteners such as nails or screws that must pass through the metal sheet. Accordingly, proper placement of the fasteners through the sheet is necessary to ensure that the fasteners properly engage the underlying roof beams. The metals sheets often have elongated, parallel ridges formed therein to provide structural integrity.

SUMMARY

A metal punch assembly for use with a ridged metal sheet includes a base member and a plurality of punches. The base member has an outer surface that defines a plurality of parallel grooves. Each of the punches has a head, a sharp tip, and a shaft interconnecting the respective tip and respective head. Further, each of the punches is operatively connected to to the base member such that each of the punches is linearly translatable between a respective retracted position and a respective extended position relative to the base member.

The apparatus improves upon the prior art by enabling the accurate and efficient formation of holes in a metal sheet. More specifically, the grooves formed by the base member are engageable with the ridges on the sheet so that the motion of the apparatus is limited to translation in two opposite directions. That is, interaction between the surface forming the grooves and the surface forming the ridges prevents lateral motion of the apparatus relative to the metal sheet while permitting movement in the direction of the ridges, thereby insuring that holes are formed linearly.

The punches are movable to their extended positions through linear translation, which enables the punches to be struck with a hammer or other hand tool or striking implement to form the holes, thereby providing a light-weight and cost-effective system for forming the holes. The plurality of punches enables the formation of multiple holes when the assembly is at any given position relative to the metal sheet. Further, the assembly may be slid along the sheet to multiple positions relative to the metal sheet, where multiple holes may again be formed, further increasing efficiency and accuracy of hole placement. A corresponding method is also provided.

The above features and advantages and other features and advantages of the present disclosure are readily apparent from the following detailed description of the best modes for carrying out the disclosure when taken in connection with the accompanying drawings

DETAILED DESCRIPTION

Figure 1:
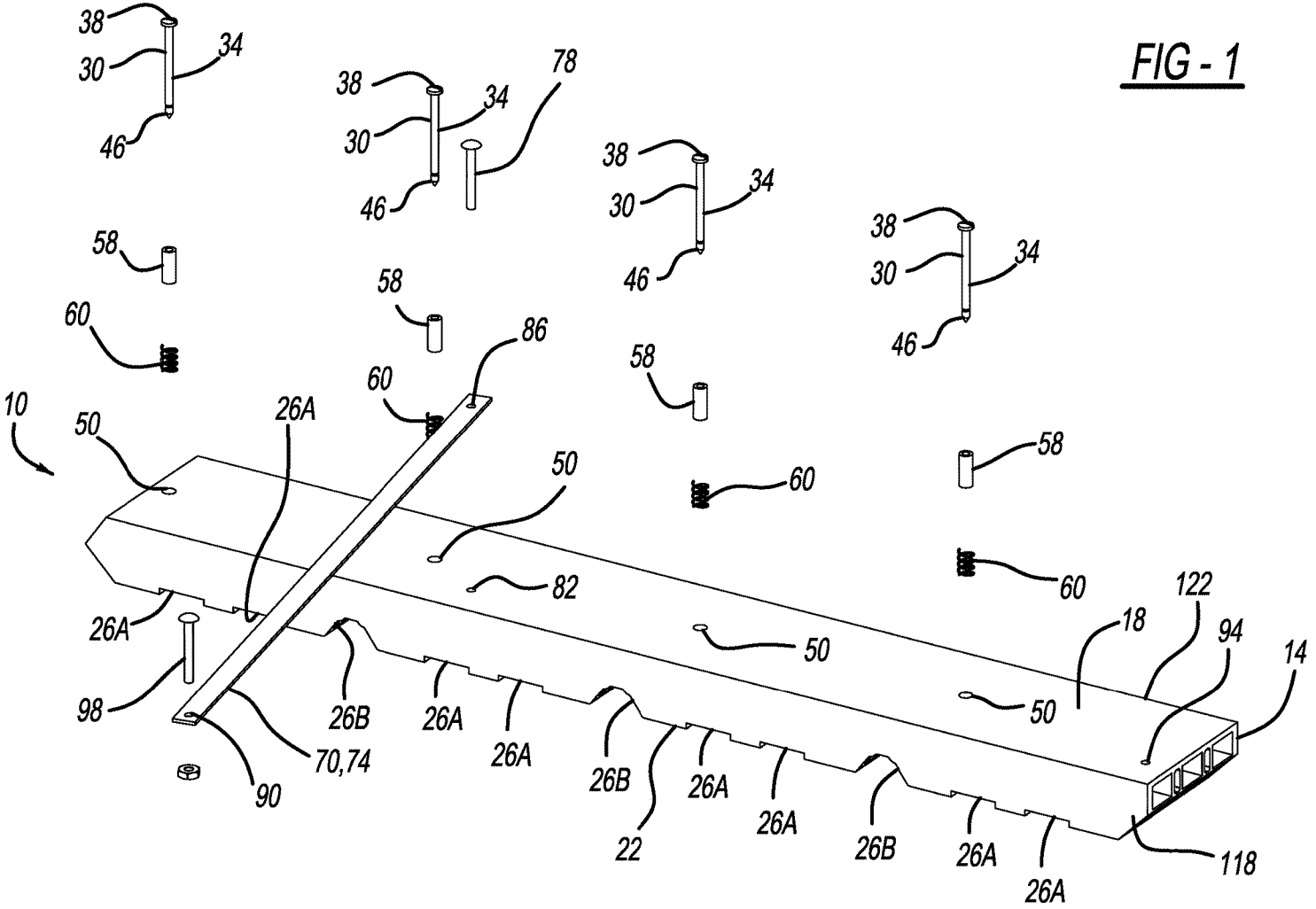
FIG. 1 is a schematic, perspective, exploded view of a metal punch assembly in accordance with the claimed invention.
Figure 2:
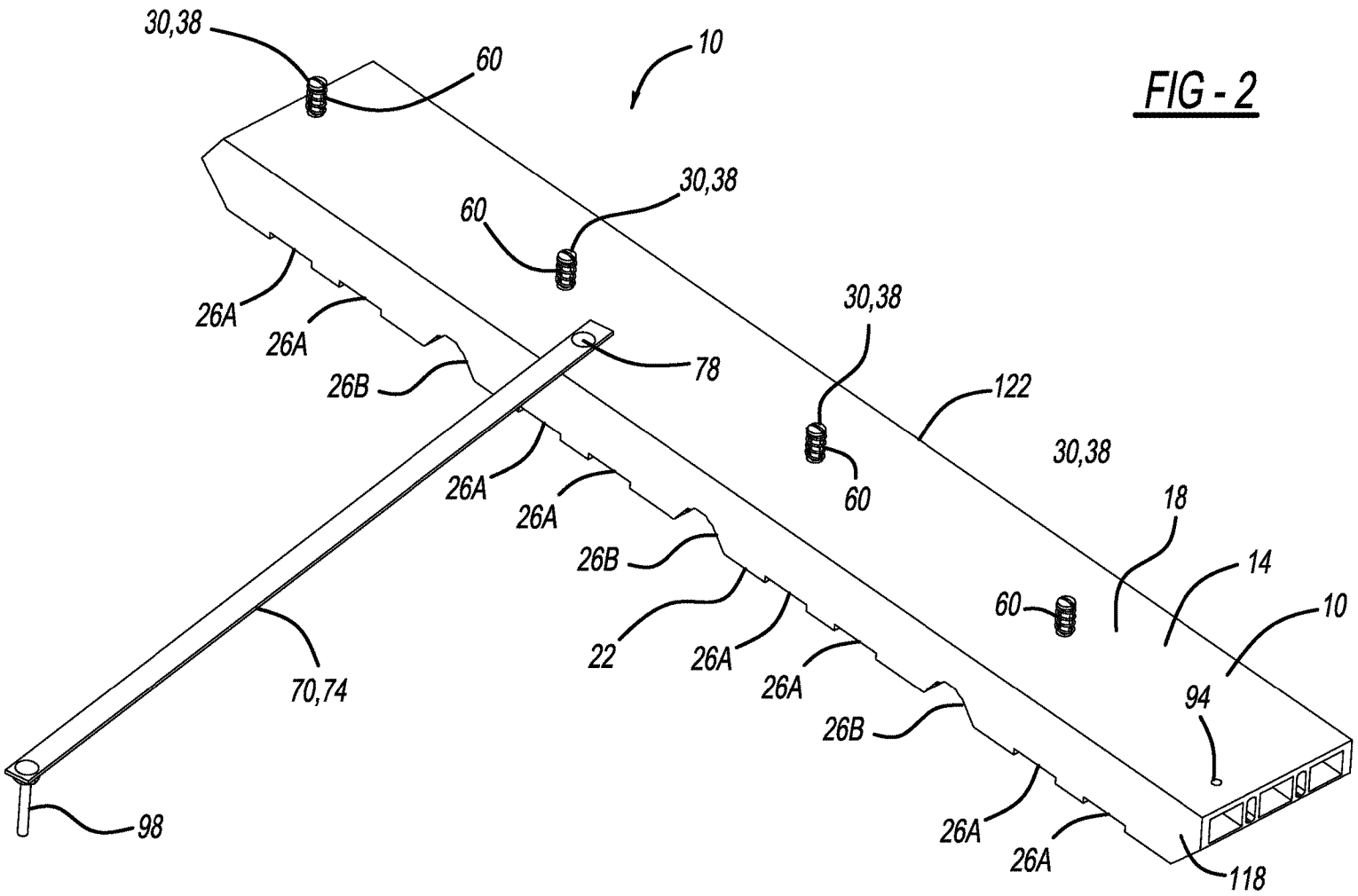
FIG. 2 is a schematic, perspective view of the metal punch assembly of FIG. 1.

Referring to the Figures, wherein like reference numbers refer to like components throughout, a sheet metal punch assembly 10 is schematically depicted. The punch assembly 10 is configured to punch holes in a metal sheet, such as the one shown at 12 in FIGS. 3-6. Referring specifically to FIGS. 1 and 2, the punch assembly 10 includes a base member 14 having an outer surface, which includes a first outer surface portion 18 and a second outer surface portion 22. The first outer surface portion 18 and the second outer surface portion 22 are on opposite sides of the base member 14 from one another. The first outer surface portion 18 is generally planar in the embodiment depicted, though the first outer surface portion may be characterized by contours or other geometry within the scope of the claims. The second outer surface portion 22 defines a plurality of parallel grooves 26A, 26B. It should be noted that, although the base member 14 depicted is characterized by a single piece of material, a base member may include a plurality of pieces operatively interconnected within the scope of the claimed invention.

The punch assembly 10 also includes a plurality of punches 30. The punch assembly 10 in the embodiment depicted includes four punches 30. Each of the punches 30 includes a respective shaft portion 34, a head 38, and a tapered or conical end 42 terminating at a sharp tip 46. The punches 30 are movably mounted with respect to the base member 14. More specifically, the base member 14 defines four passageways 50, i.e., holes, each of which extends through the base member 14 from the first outer surface portion 18 to the second outer surface portion 22. Each of the punches 30 is partially disposed within a respective one of the passageways 50.

Figure 5:
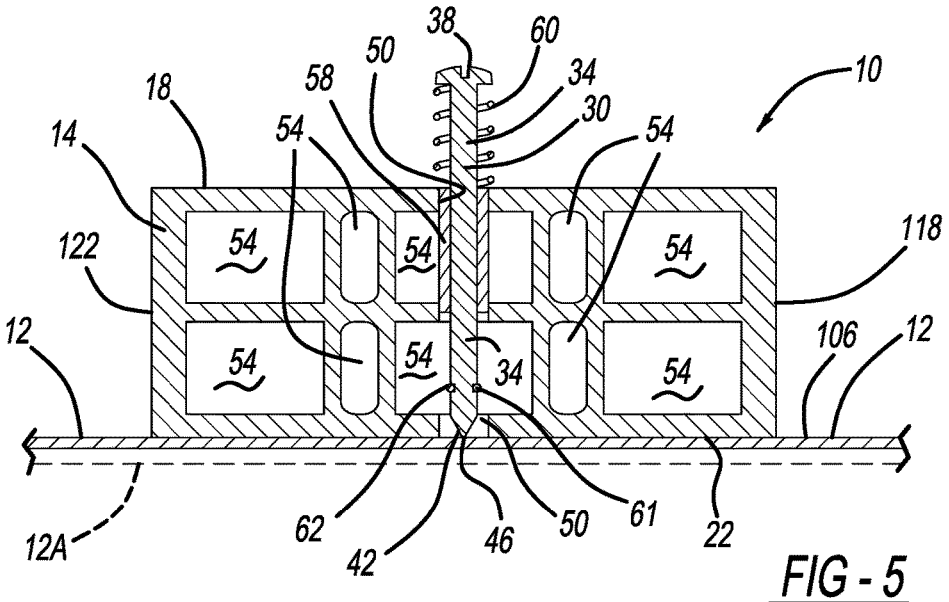
FIG. 5 is a schematic, cross-sectional side view of the metal punch assembly of FIGS. 1-4 with a metal punch in a first, retracted position.
Figure 6:
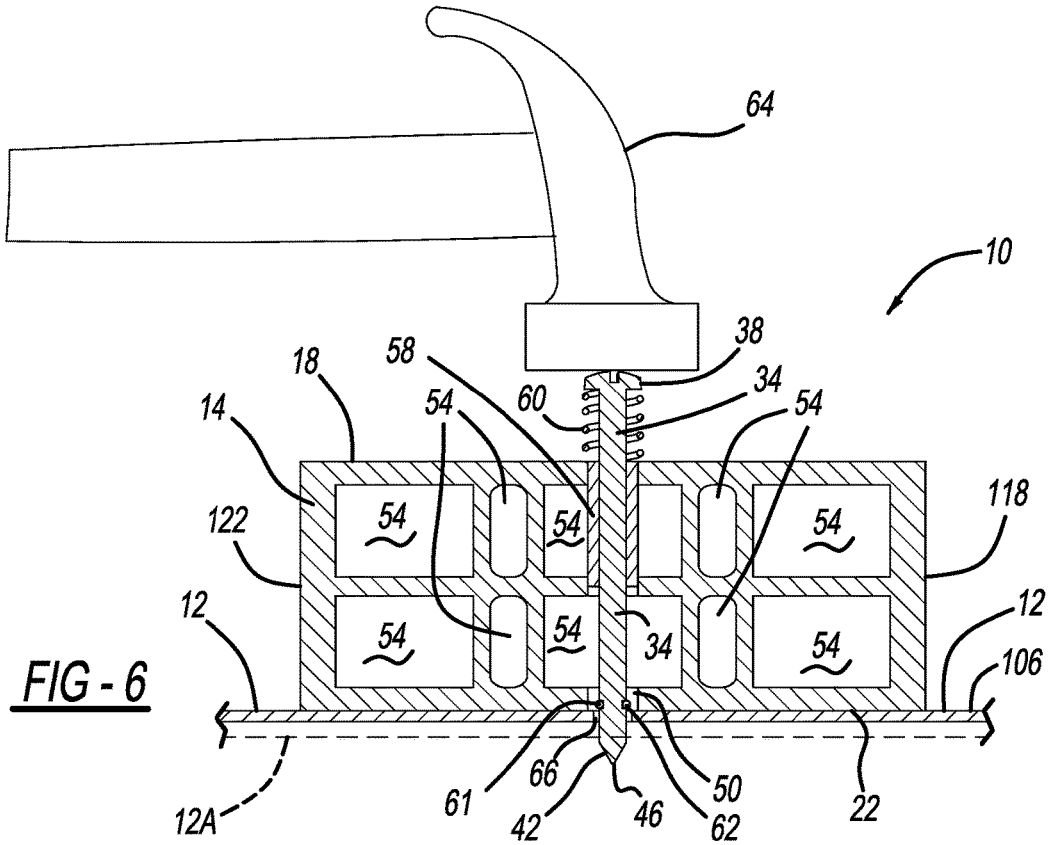
FIG. 6 is a schematic, cross-sectional side view of the metal punch assembly of FIG. 5 with the metal punch in a second, extended position.

FIGS. 5 and 6 depict one of the punches 30 disposed in one of the passageways 50, and are representative of all of the passageways 50 and punches 30. Referring specifically to FIGS. 5 and 6, the base member 14 in the embodiment depicted is not solid but instead defines a plurality of chambers 54 therein. Accordingly, the passageways 50 are at least partially coextensive with portions of chambers 54. The presence of the chambers 54 decreases the mass of the base member 14 compared to a solid base member. However, and within the scope of the claimed invention, the base member 14 may be substantially solid to make the base member 14 stronger and more rigid. If a generally solid base member is employed, the passageways 50 may, for example, be cylindrical borings.

Referring again to FIG. 1, the punch assembly 10 in the embodiment depicted includes four bushings 58, each of which is disposed within a respective one of the passageways 50 and extends through one of the chambers 54. Each of the punches 30 extends through a respective one of the bushings 58 to assist in limiting movement of the punches 30 relative to the base member 14. More specifically, and with reference to FIGS. 5 and 6, the inner diameter of each bushing 58 is marginally larger than the outer diameter of each punch 30, and thus each punch 30 is limited to substantially linear movement (relative to the base member) along the center line of its respective bushing 58. However, rotation of the punch 30 about the center line of the bushing is possible, but not necessary, during movement of the punch 30 between its extended and retracted positions, and thus the punch 30 is linearly translatable between the extended and retracted positions. The bushings 58 in the embodiment shown are connected to the base member 14 by adhesive bonding or by friction.

The punch 30 is shown in a first, i.e., retracted, position relative to the base member 14 in FIG. 5. In the first position, the punch 30 is disposed such that the end 42 and tip 46 do not extend outside the passageway 50, as shown in FIG. 5, or, alternatively, do not extend far outside the passageway 50, and the head 38 is outside the passageway 50 on the side of the base member 14 defined by the first outer surface portion 18. The punch assembly 10 includes four coil springs 60. The shaft 34 of each punch 30 extends through a respective one of the coils springs 60 such that each of the coil springs 60 is disposed between the first outer surface portion 18 and a respective head 38 of one of the punches 30. Accordingly, each coil spring 60 contacts the first outer surface portion 18 and a head 38 of a punch 30, thereby biasing the punch 30 in its first position relative to the base member 14. The spring 60 is in an unstressed state in FIG. 5.

The punch 30 is movable to its second, i.e., extended, position relative to the base member 14 by exerting a force on the head 38 to overcome the bias of the spring 60. Each head 38 in the first position is unobstructed such that it can be hit with a hammer 64 or other striking instrument to move the punch 30 to the second position, as shown in FIG. 6. As used in the claims, a "hammer" includes any striking instrument or tool. Referring specifically to FIG. 6, the tip 46 of the punch 30 extends further from the second outer surface portion 22 in the second position than in the first position. When the punch assembly 10 is engaged with the metal sheet 12, as shown in FIGS. 5 and 6, the second outer surface portion 22 contacts the sheet 12, and the movement of the punch 30 to the second position causes the tip 46 to protrude from the passageway 50, past surface portion 22, and thereby piercing the sheet 12 and forming a hole 66 in the metal sheet 12.

The punch assembly 10 improves upon the prior art by enabling sufficient force and energy to be applied to the punches 30 (by striking the heads 38 of the punches 30 with a hammer or other instrument) so that the punches 30 can form an actual hole in the metal sheet, which facilitates the insertion of a screw or other fastener when connecting the sheet 12 to a roof or other structure. Furthermore, multiple sheets 12 may be processed at once. For example, a second metal sheet, shown in phantom at 12A, may be punched at the same time that metal sheet 12 is punched by placing the second metal sheet 12A directly under metal sheet 12.

The punches 30 are retained relative to the base member 30 by the heads 38, which have a larger diameter than the passageways 50 and the bushings 58, and by o-rings 62. Each punch 30 defines an annular groove 61 in its respective shaft portion 34. A respective o-ring 62 is disposed within the annular groove 61 of each punch 30. The o-rings 62 have an outer diameter larger than the inner diameter of the bushings 58.

Referring again to FIGS. 1-4, the punch assembly 10 also includes a spacing member 70, which, in the embodiment depicted, is a flat, rectangular rod 74. The rod 74 is movably mounted with respect to the base member 14, and, more specifically, the rod 74 is rotatably connected to the base member 14 by a bolt 78. The base member 14 defines a hole 82 in the first outer surface portion 18, and the rod 74 defines a hole 86 at one end of the rod 74. The bolt 78 extends through both hole 86 and hole 82 and engages the base member 14 to secure the rod 74 to the base member 14 such that the rod 74 is selectively pivotable or rotatable with respect to the base member 14 about an axis that is coextensive with the center line of the bolt 78.

Figure 3:
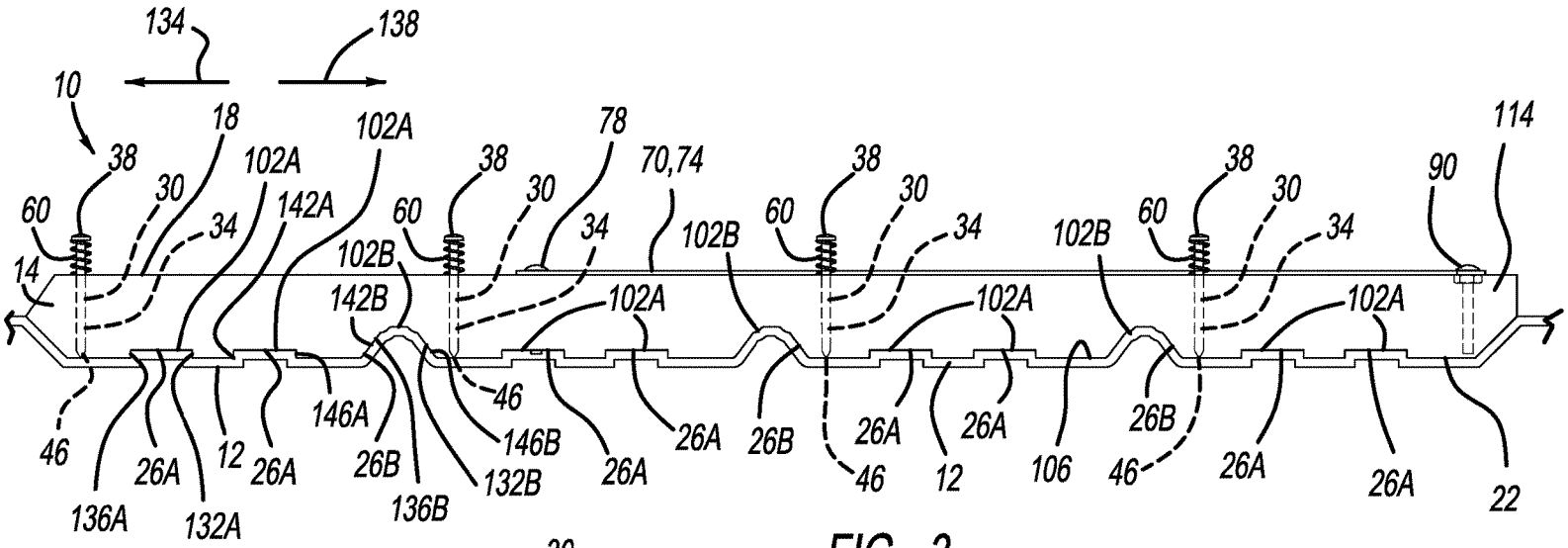
FIG. 3 is a schematic, side view of the metal punch assembly of FIGS. 1 and 2.
Figure 4:
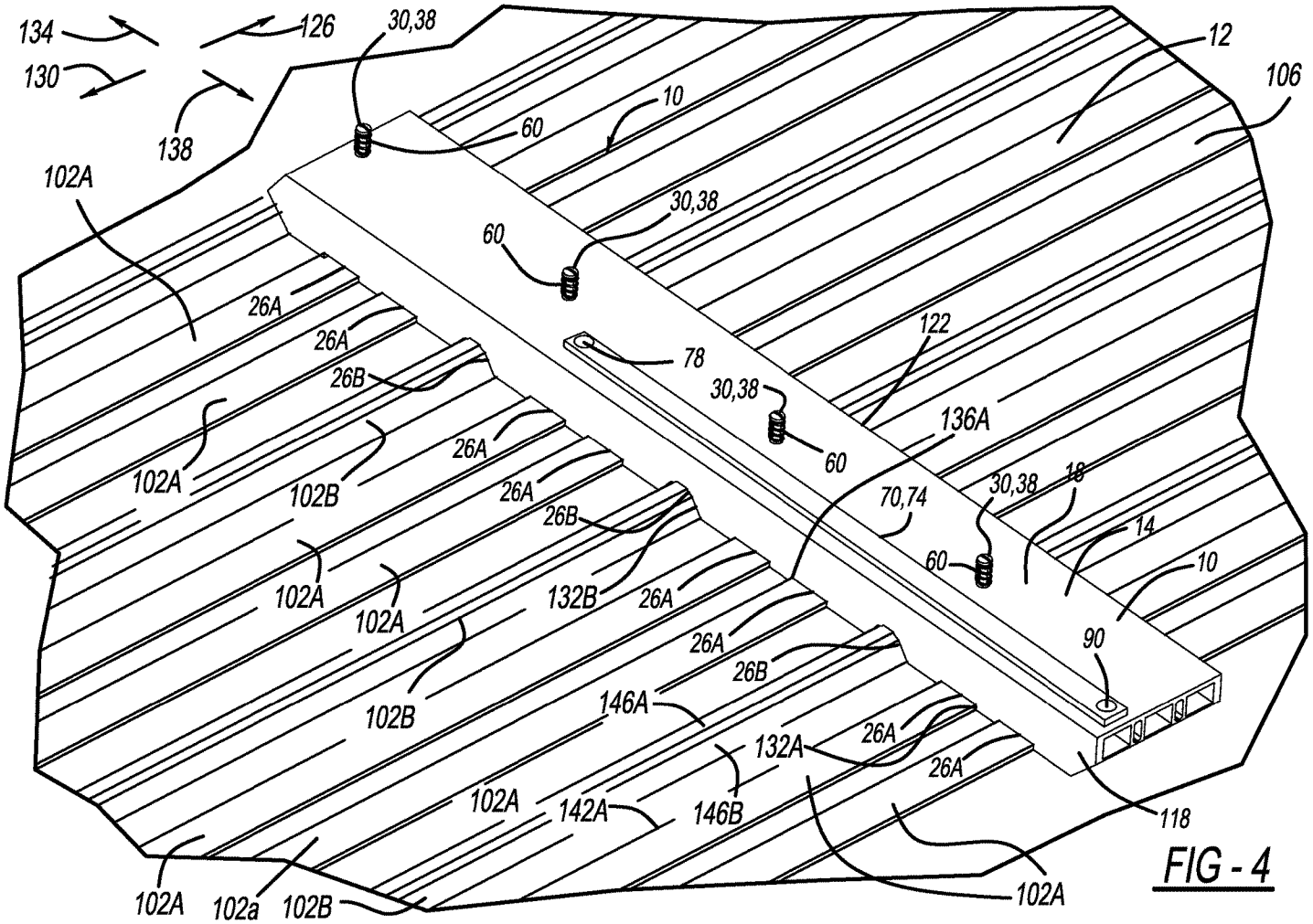
FIG. 4 is a schematic, perspective view of the metal punch assembly of FIGS. 1-3 engaging a metal roof panel.

The rod 74 defines another hole 90 at the end opposite hole 86. The base member 14 defines another hole 94 in the first outer surface portion 18. Another bolt 98 is secured to the rod 74 through hole 90. Hole 94 is positioned such that the bolt 98 is inserted therein when the rod 74 is in a retracted or stored position relative to the base member 14, as shown in FIGS. 3 and 4. The interaction between the bolt 98 and the base member 14 inside hole 94 retains the rod 74 in the retracted or stored position. To move the rod 74 from the stored or retracted position, the rod 74 must be elastically bent to remove the bolt 98 from the hole 94.

The passageways 50 are aligned with one another such that the punches 30 are arranged along a straight line. The punches 30 are spaced from one another to create holes in the metal sheet 12 that are spaced apart from one another in the same manner that roof beams are spaced apart from one another so that when the metal sheet 12 is placed on a roof, each of the holes formed in the metal sheet 12 is aligned with a respective roof beam.

The grooves 26A, 26B are configured to position the punch assembly 10 relative to the metal sheet 12 so that the punches 30 are properly positioned relative to the metal sheet to punch holes in desired locations. More specifically, and with reference to FIGS. 3-4 and 7, the metal sheet 12 is generally flat and planar with the exception of elongated protuberances, i.e., ridges 102A, 102B, in the surface 106 of the sheet 12. The ridges 102A, 102B are parallel to one another and are ridges that extend substantially from one end 110 of the sheet 12 to the other end 114 of the sheet 12. Similarly, grooves 26A, 26B in the base member 14 extend from one end 118 of the base member 14 to the opposite end 122 of the base member 14.

The grooves 26A, 26B are sufficiently sized, shaped, and positioned such that, when the punch assembly 10 is sufficiently positioned with respect to the sheet 12, each ridge 102A extends into a respective one of the grooves 26A, and each ridge 102B extends into a respective one of the grooves 26B. It should be noted that, within the scope of the claims, a metal sheet 12 may have more ridges than the punch assembly has grooves, and accordingly not every ridge will extend into a groove. Furthermore, and within the scope of the claims, a groove may contain more than one ridge. Accordingly, as used in the claims, each of said grooves at least partially containing a respective one of the ridges includes containing one or more ridges.

When the ridges 102A, 102B are disposed within respective grooves 26A, 26B, the punch assembly 10 is selectively slidable across the surface of the metal sheet 12 in two opposing directions 126, 130. However, movement of the punch assembly 10 laterally relative to the metal sheet 12 (i.e., in either direction 134 or 138, which are perpendicular to directions 126, 130) is limited or prevented. More specifically, and with reference to FIG. 3, outer surface portion 22 includes segments 132A, 132B that generally face direction 134, and segments 136A, 136B that generally face direction 138. Segments 132A, 132B and 136A, 136B define lateral surfaces of grooves 26A, 26B, respectively. Surface 106 of sheet 12 includes segments 142A, 142B that generally face direction 134, and segments 146A, 146B that generally face direction 138. Segments 142A, 142B and 146A, 146B define lateral surfaces of ridges 102A, 102B, respectively. Contact between surface segments 132A and 146A, and between 132B and 146B prevents movement of the punch assembly 10 in direction 138; similarly, contact between surfaces 136A and 142A, and between 136B and 142B prevents movement of the punch assembly 10 in direction 134. In other words, the surfaces defining the lateral edges of the grooves 26A, 26B interact with the surfaces defining the lateral edges of the ridges 102A, 102B to prevent lateral (i.e., perpendicular to the ridges 102A, 102B) movement of the punch assembly 10 relative to the sheet 12.

Figure 7:
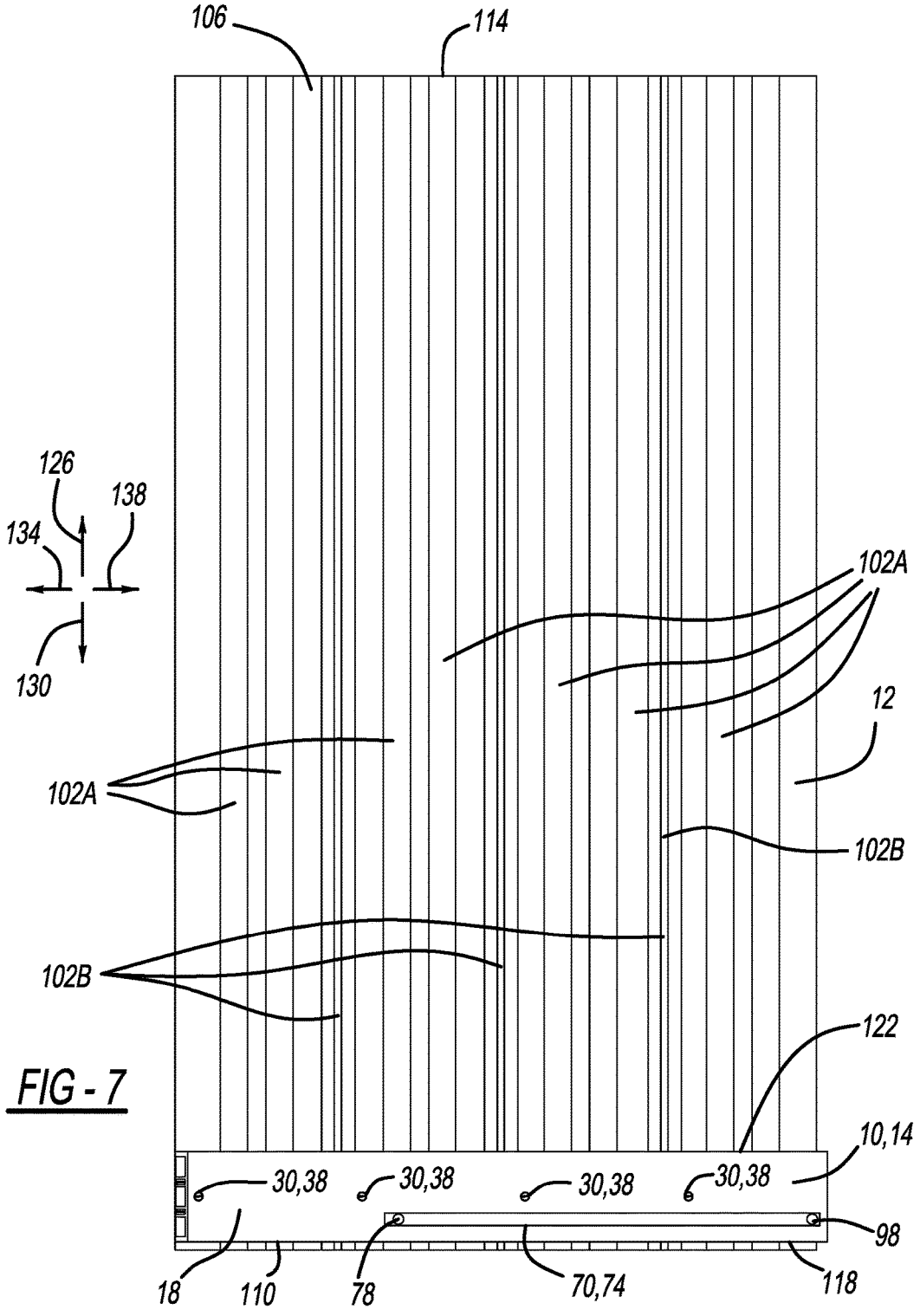
FIG. 7 is a schematic, top view of the metal punch assembly in a first position relative to the metal sheet.
Figure 8:
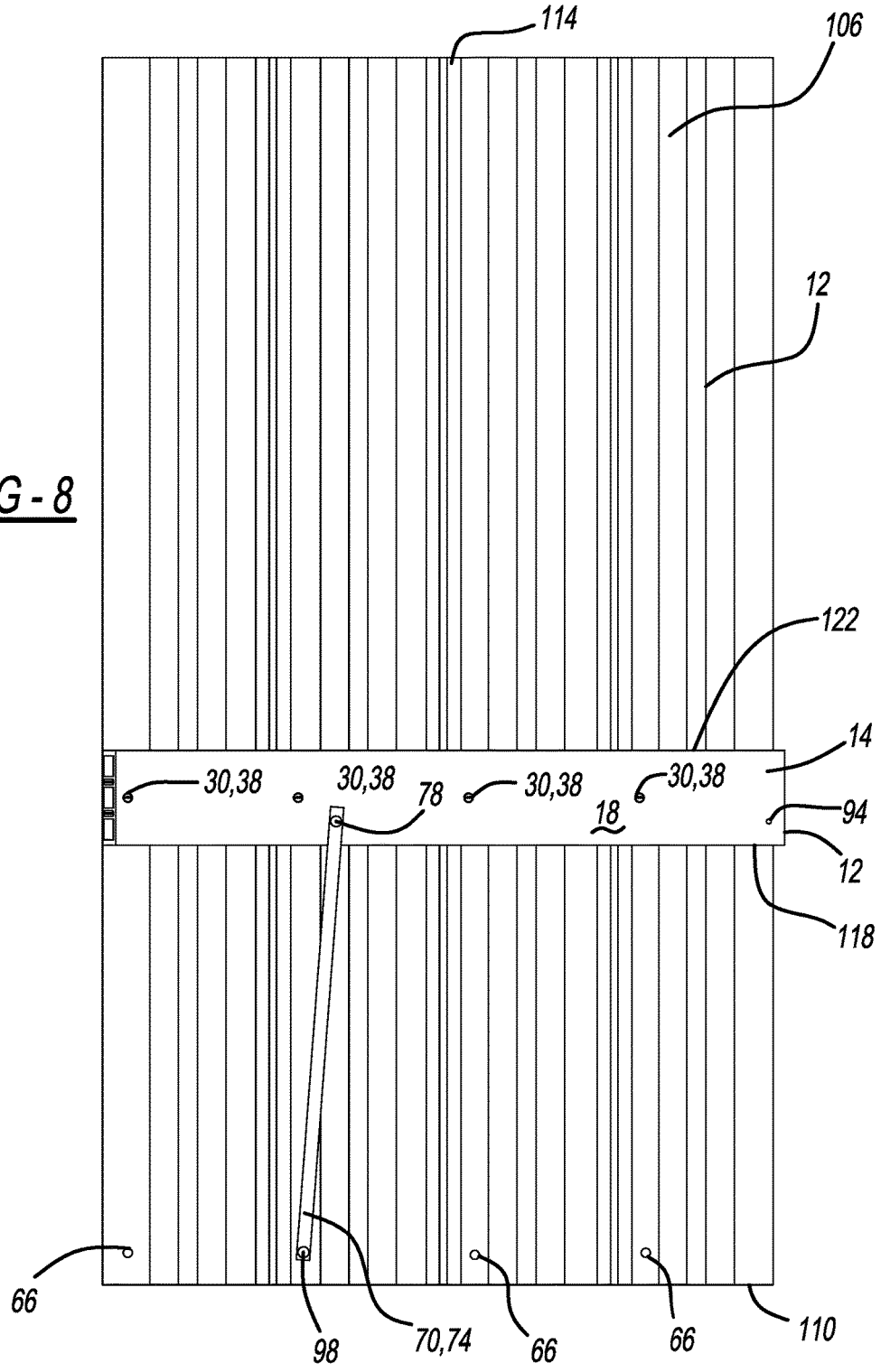
FIG. 8 is a schematic, top view of the metal punch assembly in a second position relative to the metal sheet.
Figure 9:
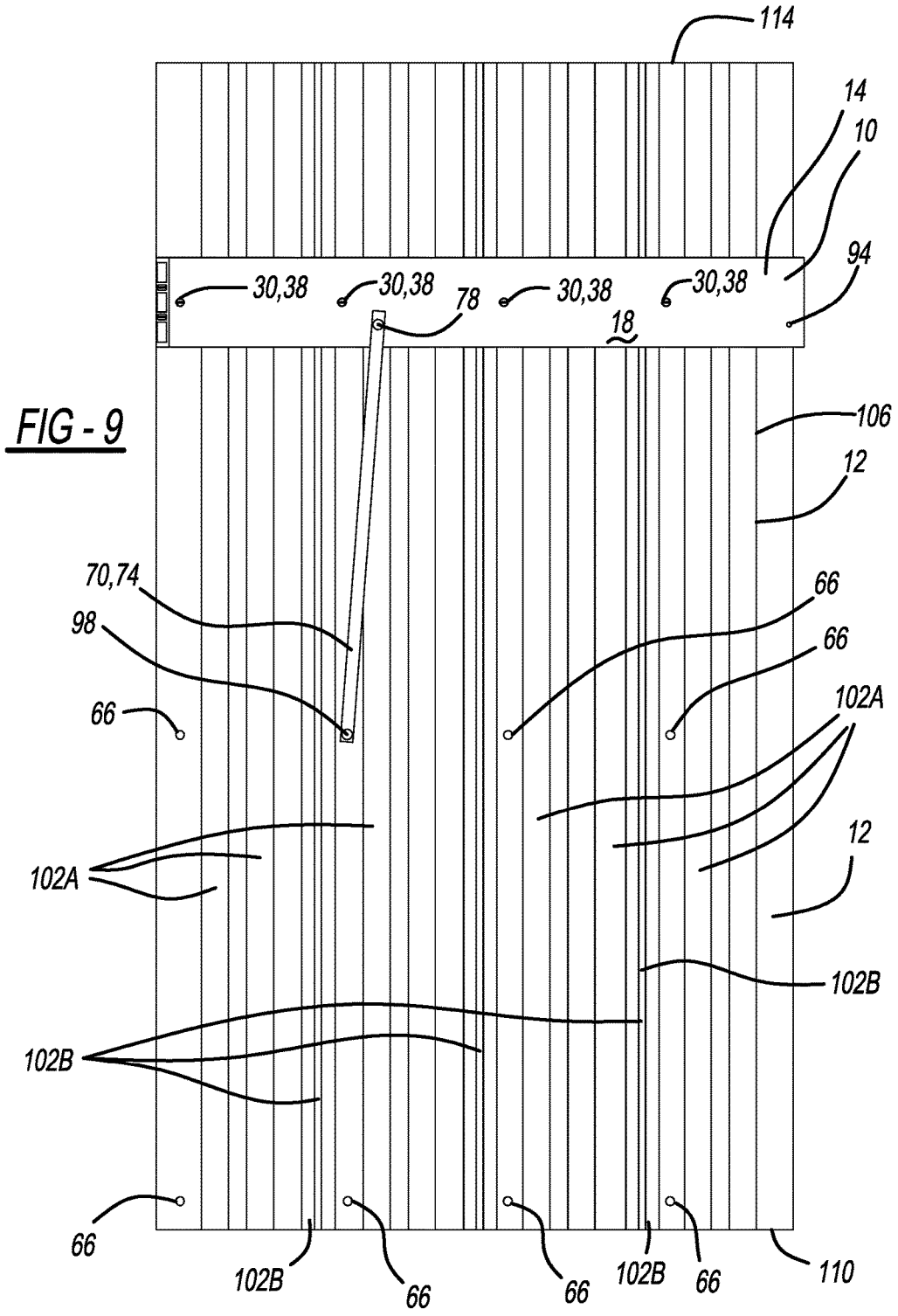
FIG. 9 is a schematic, top view of the metal punch assembly in a third position relative to the metal sheet.

FIGS. 7-9 schematically depict a method of using the punch assembly 10. The method includes placing the punch assembly 10 in a first position with respect to the metal sheet 12, as shown in FIG. 7. In the first position, the edge 118 of the punch assembly 10 is aligned with, parallel to, and adjacent to the edge 110 of the metal sheet 12; each of the grooves 26A has a corresponding one of the ridges 102A at least partially disposed therein; each of the grooves 26B has a corresponding one of the ridges 102B at least partially disposed therein; and at least a portion of surface 106 of the metal sheet 12 contacts at least part of the outer surface portion 22 of the base member 14, as shown in FIG. 7.

The spacing member 70 (i.e., rod 74) is in its retracted or stored position in FIG. 7. The method also includes hitting each of the heads 38 of the four punches 30 with a hammer (shown at 64 in FIG. 6) or other striking tool when the punch assembly 10 is in the first position. Hitting each of the heads 38 includes hitting or striking each of the heads 38 with sufficient force such that each of the punches 30 moves to its respective extended position and thereby punctures the sheet 12 to make a respective hole 66 therein. The holes formed by striking the heads 38 when the assembly 10 is in the first position are shown at 66 in FIG. 8.

The method further includes sliding the punch assembly 10 along the surface 106 of the metal sheet 12 in direction 126 to a second position, as shown in FIG. 8. Referring to FIG. 8, sliding the punch assembly 10 to the second position includes moving the rod 74 from its retracted or stored position, and aligning bolt 98 with a reference feature in the metal sheet 12, such as one of the holes 66 formed when the punch assembly 10 was in its first position. The rod 74 is configured such that, when the bolt 98 is aligned with, or adjacent to, one of the previously punched holes 66, as shown in FIG. 8, the punch assembly 10, which has not been moved laterally relative to the metal sheet 12, is in the second position and ready to punch another row of holes.

Accordingly, the method further includes hitting or striking each of the heads 38 with sufficient force to cause each of the punches 30 to puncture the sheet 12 and thereby create a respective hole 66 when the punch assembly is in the second position, as show in FIG. 8. The holes 66 formed when the punch assembly 10 is in the second position are shown in FIG. 9.

The process is of sliding the punch assembly 10 to another position relative to the metal sheet 12 is repeated until all desired holes are formed in the sheet. For example, the method may include sliding the punch assembly 10 along surface 106 to a third position. The punch assembly 10 is in the third position when the bolt 98 is aligned with, or adjacent to, one of the holes 66 formed when the punch assembly 10 was in the second position. Each of the heads 38 are struck when the punch assembly 10 is in the third position to create another row of holes in the metal sheet 12.

It should be noted that the dimensions of the embodiment depicted are merely examples and may vary within the scope of the claimed invention. It should also be noted that the punch assembly 10 could include two or more punches within the scope of the claimed invention. The quantity of punches may vary with, for example, the width of the metal sheets being used and the number of holes desired to be punched in the metal sheets. It should be further noted that, although the sheet 12 shown and described is a metal roof panel, any metal sheet, such as metal siding or other building component, could be used within the scope of the claimed invention.

Figure 10:
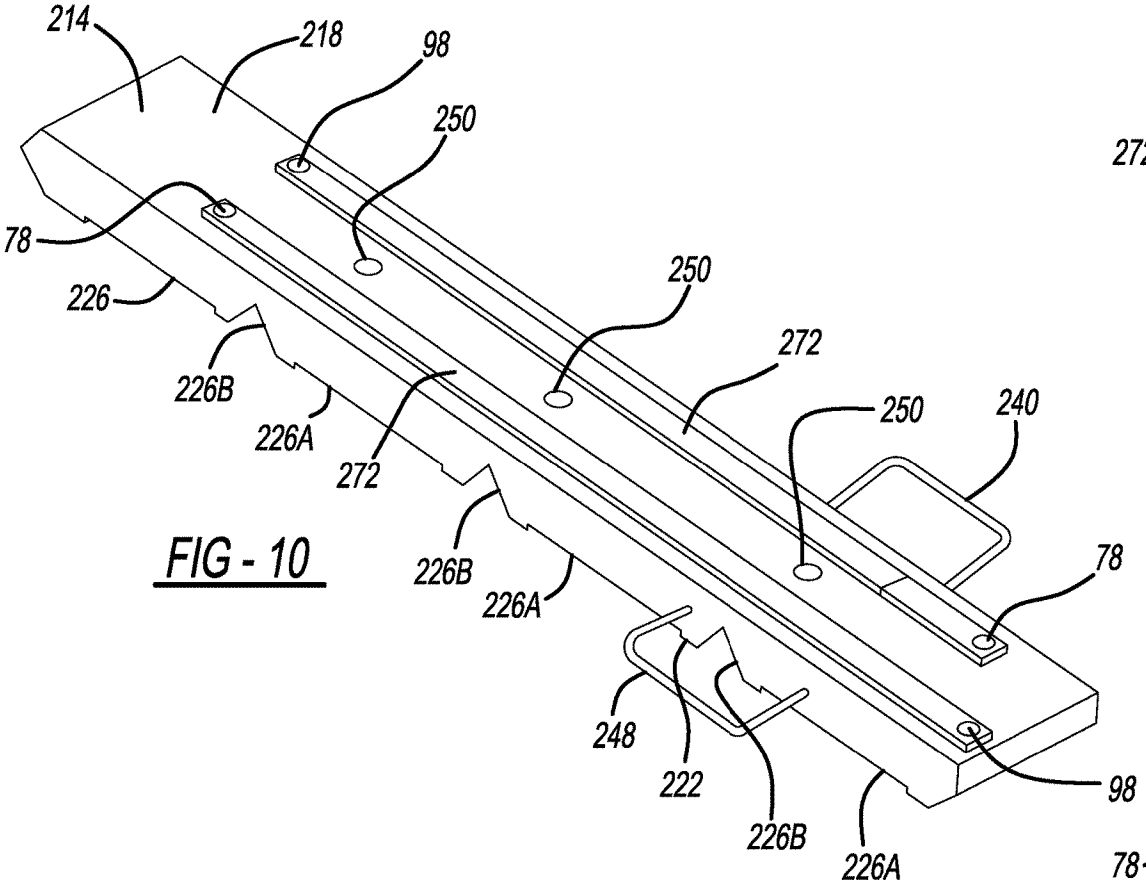
FIG. 10 is a schematic, perspective view of an alternative metal punch assembly within the scope of the claims.

Referring to FIG. 10, an alternative punch assembly embodiment is schematically depicted. Base member 214 is substantially similar to the base member 14, but the second outer surface portion 222 defines grooves 226A, 226B that are differently sized and shaped compared to the grooves 26A, 26B. More specifically, grooves 226A are sized the at least partially contain two of the ridges 102A in the metal sheet. Further, the punch assembly of FIG. 10 includes two spacing members 272 rotatably connected to the base member 214 so that the assembly is usable in two different directions. Optional handles 240, 248 are mounted to the base member 214 for ease of handling during operation or transportation. Passageways 250 extend through the base member 214 from the first outer surface portion 218 to the second outer surface portion 222, but have a different configuration than passageways 50.

Figure 12:
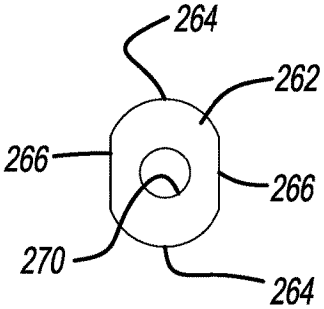
FIG. 12 is a schematic, top view of a bushing shown in FIG. 11.
Figure 11:
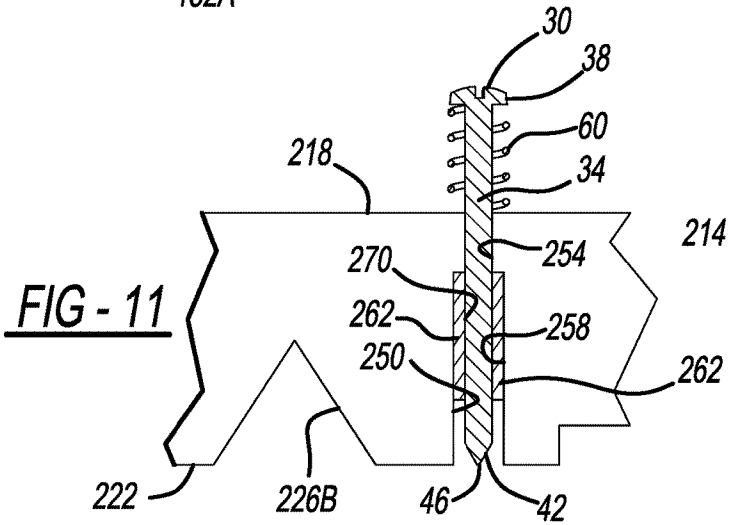
FIG. 11 is a schematic, cross-sectional, side view of the the metal punch assembly of FIG. 10.

More specifically, and with reference to FIG. 11, passageway 250 includes a first portion 254 and a second portion 258. The first portion 254 is characterized by a smaller diameter than the second portion 258; the diameter of the first portion is slightly larger than the diameter of the shaft portion 34 of the punch 30. Each punch 30 has a respective bushing 262 connected thereto. More specifically, the inner diameter 270 of the bushing 262 is threaded, and the shaft portion 34 of each punch is threaded (not shown). The shaft portion 34 is threaded through the inner diameter of the bushing 262 so that the bushing 262 moves with the punch from its retracted position to its extended position. The bushing is disposed within passageway portion 258. The diameter of passageway portion 258 is slightly larger than the outer diameter of the bushing 262 so that movement of the bushing relative to the base member 214 is substantially limited to linear translation. Referring to FIG. 12, the bushing is generally cylindrical with portions of the outer diameter 264 forming arcs. Flat portions 266 of the outer surface are formed to facilitate rotation of the bushing relative to the punch 30 when the threads are being engaged. As shown in FIG. 11, base member 214 is substantially solid, i.e., it does not include internal chambers such as those shown at 54 in FIGS. 5 and 6.

Figure 13:
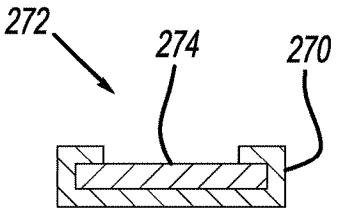
FIG. 13 is a schematic, cross-sectional side view of an alternative spacing member.
Figure 14:
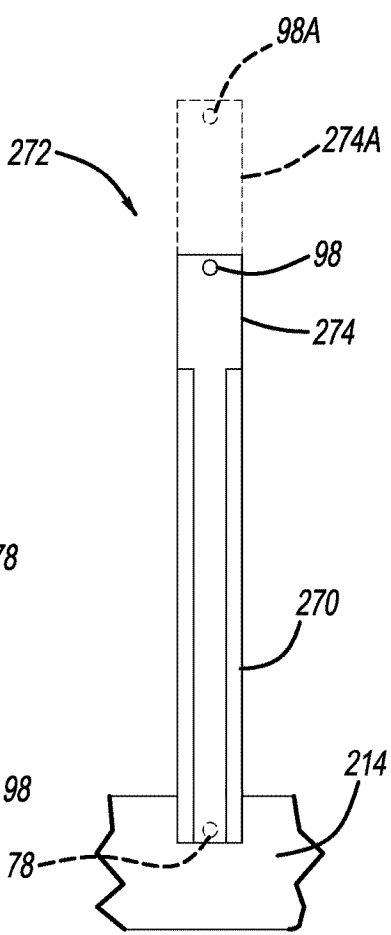
FIG. 14 is schematic top view of the alternative spacing member of FIG. 20.

Referring to FIGS. 13 and 14, an alternative spacing member 272 is schematically depicted. The spacing member 272 includes a first rod 270 that has a C-shaped cross-section which forms a channel. A second, flat rod 274 is disposed within the channel so that that rod 274 is selectively translatable relative to the first rod 270. Rod 270 defines a hole through which fastener 78 rotatably mounts the first rod 270 to the base member 214, and rod 274 has fastener 98 attached thereto for insertion into a hole formed in the first outer surface portion 218, similar to the hole shown at 94 in FIG. 1. Accordingly, the length of the spacing member 272 is selectively variable by sliding rod 274 relative to rod 270, such as to the position shown in phanton at 274A in FIG. 14. A locking feature (not shown) may be employed to lock the rod 274 relative to rod 270.

While the best modes for carrying out the invention have been described in detail, those familiar with the art to which this invention relates will recognize various alternative designs and embodiments for practicing the invention within the scope of the appended claims.

The invention claimed is:

1. A method of forming holes in a metal sheet defining a plurality of parallel ridges, the method comprising:

providing a punch assembly having a base member and a plurality of punches, the base member having an outer surface portion that defines a plurality of grooves, each of said punches being movably mounted with respect to the base member and selectively linearly translatable between a respective retracted position and a respective extended position;

positioning the punch assembly in a first position relative to the metal sheet such that the outer surface portion contacts the metal sheet and each of the grooves has a respective one of the ridges disposed therein;

striking each of said punches with a hammer such that each of said punches moves to its respective extended position and thereby forms a respective hole in the metal sheet when the punch assembly is in the first position;

sliding the punch assembly along the metal sheet to a second position; and striking each of said punches with a hammer with sufficient force such that each of said punches forms a respective hole in the metal sheet when the punch assembly is in its second position relative to the metal sheet;

wherein the punch assembly includes a rod rotatably connected with respect to the base member; and wherein the method further includes using the rod to determine the second position by sliding the punch assembly from the first position until a portion of the rod is adjacent to, or aligned with, one of the holes formed in the metal sheet when the punch assembly was in the first position.

2. The method of claim 1, further comprising placing another metal sheet under the metal sheet prior to said striking each of the punches such that each punch forms a hole in said another metal sheet.

* * * * *